United States Patent [19]

Yasuhara

[11] Patent Number: 4,671,224

[45] Date of Patent: Jun. 9, 1987

[54] APPARATUS FOR CONTROLLING A POWER SUPPLY TO A GLOW PLUG FOR A VEHICULAR DIESEL ENGINE

[75] Inventor: Seishi Yasuhara, Yokosuka, Japan

[73] Assignee: Nissan Motor Company, Ltd., Japan

[21] Appl. No.: 773,192

[22] Filed: Sep. 6, 1985

[30] Foreign Application Priority Data

Sep. 25, 1984 [JP] Japan ..... 59-198634

[51] Int. Cl.[4] ..... F02P 19/02

[52] U.S. Cl. ..... 123/145 A; 123/179 BG; 219/205; 219/507

[58] Field of Search ..... 123/179 B, 179 BG, 179 H, 123/145 A; 219/205, 262, 507

[56] References Cited

U.S. PATENT DOCUMENTS 4,283,619 8/1981 Abe ..... 219/492
4,318,374 3/1982 Yasuhara ..... 123/179 BG
4,391,237 7/1983 Abe et al. ..... 123/179 H

FOREIGN PATENT DOCUMENTS 2913101 10/1979 Fed. Rep. of Germany .
2931630 3/1980 Fed. Rep. of Germany .

*Primary Examiner*—Andrew M. Dolinar
*Attorney, Agent, or Firm*—Lowe, Price, LeBlanc, Becker & Shur

[57] ABSTRACT

An apparatus for controlling a power supply to a glow plug for a vehicular internal combustion engine to preheat the glow plug, in which in addition to the conventional power supply circuit to the glow plug which allows the power supply current to flow into the glow plug so as to preheat the glow plug at an earlier stage when an engine key is inserted into an engine key switch apparatus, a cancel circuit is provided which halts the function of the glow plug power supply circuit for a predetermined period of time when a power supply is connected to the glow plug power supply circuit.

6 Claims, 5 Drawing Figures

APPARATUS FOR CONTROLLING A POWER SUPPLY TO A GLOW PLUG FOR A VEHICULAR DIESEL ENGINE

BACKGROUND OF THE INVENTION

1. Field of the Invention

The present invention relates generally to an apparatus for controlling a power supply to a glow plug for a vehicular Diesel engine, and more particularly to an apparatus for controlling the power supply to the glow plug located within a corresponding combustion chamber or the glow plug located within an intake air passage of a vehicular internal combustion engine. Circuitry for halting a power supply to the glow plug is provided together with circutry for supplying a power supply current to the glow plug with an engine key inserted into a key hole of an engine key switch apparatus so that power cables for these circuitry are safely connected to a power supply.

2. Description of the Prior Art

FIG. 1 shows a conventional apparatus for controlling a power supply to a glow plug in a vehicular Diesel engine in order to preheat the glow plug at an earlier stage than usual so as to facilitate engine start. The conventional apparatus shown in FIG. 1 is disclosed by Japanese Patent Application Unexamined Open No. S55-69760, published on May 26, 1980.

A DC power supply (hereinafter referred to as a battery) 1 is connected to a glow plug 5 via contacts or a relay switch 4. An electromagnetic relay coil of the relay switch 4 closes the contacts of the relay switch 4 when energized in response to a signal from a control unit 3. The control unit 3 receives a voltage signal from the battery 1 via a manually operated ignition switch 2, and outputs the signal for a predetermined period of time. Therefore, the glow plug 5 receives the voltage from the battery 1 for the predetermined period of time upon closure of the ignition switch 2. In addition to the above-described construction, a relay switch 6 is connected in parallel with the ignition switch 2. When the relay switch 6 is turned on in response to an actuation of a timer 8 which in turn is actuated for a predetermined period of time t when a key-in switch 7 is turned on, the control unit 3 energizes the electromagnetic relay coil of the relay switch 4 so that the glow plug 5 receives the voltage from the battery 1 via the relay switch 4.

In this way, with an engine key inserted in an engine key switch apparatus having such switches as a key lock position, accessory position, on switch position, and ignition switch position, the key-in switch 7 is turned on so that the control unit 3 can be actuated to start preheating of the glow plug 5 with the ignition switch 2 not yet turned on.

The glow plug power supply control circuit having the glow plug power supply line denoted by symbol A supplies the voltage from the battery 1 to the glow plug 5 with the key-in switch 7 turned on and has an advantage of improving an engine starting characteristic due to an earlier preheating of the glow plug 5. However, the following disadvantages rises since there is no safety facility in the above-described apparatus when the battery 1 is replaced or power cables are installed to form the circuitry shown in FIG. 1 with the engine key inserted in the above-described engine key switch apparatus.

That is to say, since the power supply current flows into the timer 8 with the key-in switch 7 turned on, the timer 8 is actuated to turn the relay switch 6 on so that the glow plug 5 receives the voltage from the battery 1 by means of the control unit 3.

Hence, when both terminals of the battery 1 are connected to the power cables leading to the key-in switch 7, ignition switch 2, relay switch 4, and ground, respectively, a large current will instantaneously flow into the connection portions of the above-described electrical parts during connection and disconnection operations causing a large spark will at one of the cable connection portions. Consequently, cable terminals and power supply output terminals are often damaged and secondary failures such as electric circuit-shortings often occur due to touching on mutual electrical circuits or direct grounding of a portion to which a positive voltage is applied by an operator's hand or metallic tool.

SUMMARY OF THE INVENTION

With the above-described disadvantage in mind, it is an object of the present invention to provide an apparatus for controlling the power supply to the glow plug, in which the current flow to the glow plug is interrupted during a connection operation of the battery to the glow plug power supply circuitry to secure a safe operation of connecting the battery to the glow plug power supply circuitry.

The above-described object can be achieved by providing an apparatus for controlling a power supply to a glow plug for a vehicular internal combustion engine comprising: (a) first means for allowing a power supply current to flow into the glow plug to preheat the glow plug when an engine key is inserted into a hole of an engine key switch apparatus, and (b) second means for halting the current flow into the glow plug through the first means for a predetermined period of time after a power supply for the glow plug is connected to the first means.

BRIEF DESCRIPTION OF THE DRAWINGS

A more complete understanding of the present invention may be obtained from the foregoing description taken in conjunction with the drawings in which like reference numerals designate corresponding elements and in which.

DETAILED DESCRIPTION OF THE PREFERRED EMBODIMENTS

Reference will hereinafter be made to the drawings in order to facilitate understanding of the present invention.

Figure 1:
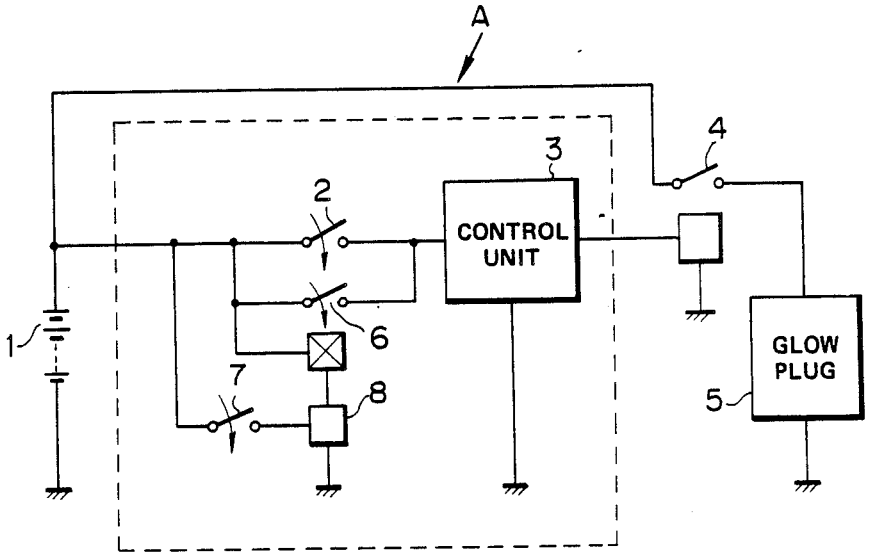
FIG. 1 (Prior Art)
FIG. 1 is a simplified circuit diagram of a conventional apparatus for controlling power supply to a glow plug disclosed in Japanese Patent Application Unexamined Open No. Sho 55-69,760.
Figure 2:
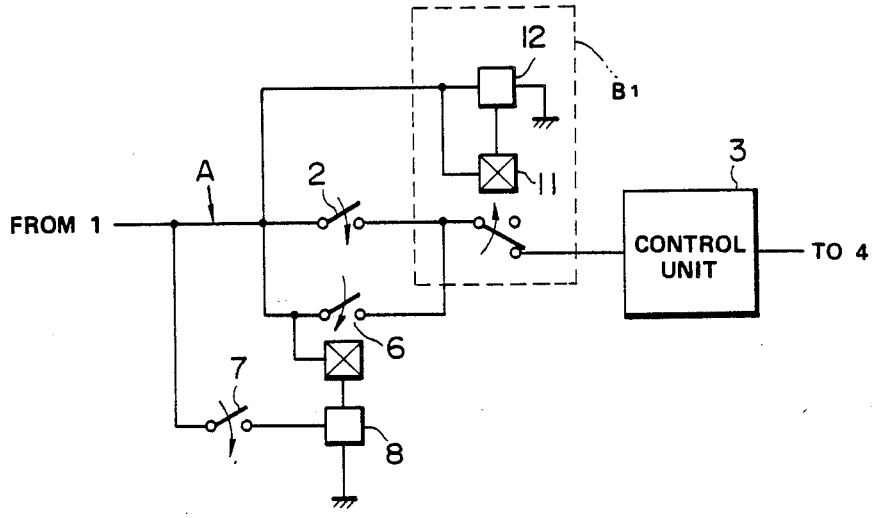
FIG. 2 is a simplified circuit diagram of a first preferred embodiment.

FIG. 2 shows a first preferred embodiment of the apparatus for controlling the power supply to the glow plug according to the present invention.

In the first preferred embodiment shown in FIG. 2, a cancel circuit $B_1$ is provided which includes a relay switch 11 which is normally turned on and which is intervened between the relay switch 6 and control unit 3, and a timer 12 connected in series with the battery 1 and actuated in response to the application of the voltage from the battery 1 for a set period of time T so as to turn off the relay switch 11.

Hence, when the battery 1 is connected to the glow plug power supply circuit line A with the engine key inserted in the engine key switch apparatus, the timer 12 is actuated in the cancel circuit $B_1$ so that the relay switch 11 is turned off for a predetermined period of time T. Therefore, when the power supply 1 is connected so that the timer 8 is actuated to turn on the relay switch 6 for the predetermined period of time t, the control unit 3 receives no voltage from the battery 1. Consequently, the glow plug 5 receives no power from the battery 5 and the operation of connecting the battery 1 to the circuit line A is carried out with safety.

It should be noted that the relationship between the set periods of time T and t in the timers 8 and 12 is expressed as $T>t$.

When the set period of time T has passed after the connection of the battery 1 to the circuit line A, the relay switch 11 is turned on. At this time, since the timer 8 is halted after the set period of time t and the relay switch 6 is turned off, the power supply to the glow plug 5 is interrupted although the key-in switch 7 is turned on. Hence, to start the power supply to the glow plug 5, once the engine key is removed from the key switch apparatus and thereafter is again inserted into a hole of the switch apparatus to again turn on the key-in switch 7. Consequently, the key-in glow control is carried out.

For the details of the engine key switch apparatus described above, Japanese Patent Application Unexamined Open No. Sho 55-69,760 and U.S. Pat. No. 4,318,374 are disclosed. The contents of these Patent documents are hereby incorporated by reference.

Figure 3:
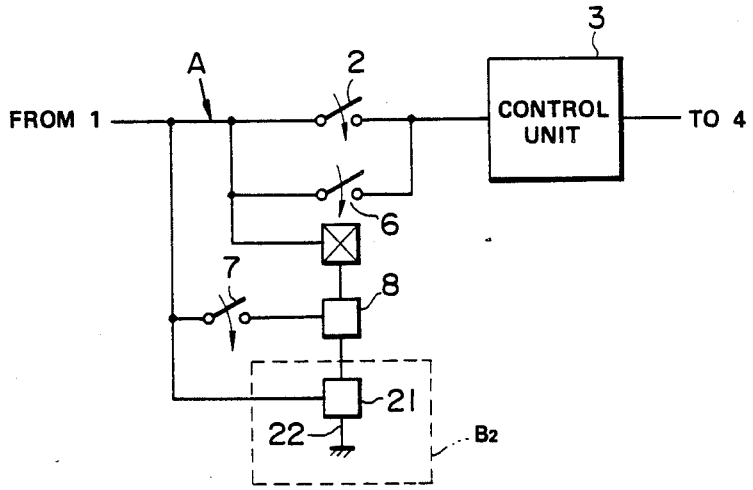
FIG. 3 is a simplified circuit diagram of a second preferred embodiment.

FIG. 3 shows a second preferred embodiment of the apparatus according to the present invention.

As shown in FIG. 3, another cancel circuit $B_2$ which directly deactivates the timer 8 by means of a timer 21 for the set period of time T ($>t$) is additionally provided.

In details, the timer 21 directly connected to the battery 1 is connected to ground 22 of the above-described timer 8. When the power supply is connected, the timer 21 is actuated so that the timer 8 is not actuated for the set period of time T, i.e., for the time exceeding the set period of time t although the current flows into the timer 8. After the set period of time T has passed, the relay switch 6 is turned off with the key-in switch 7 turned on since the set period of time t has passed. Therefore, it is necessary to remove the key from the engine key switch apparatus and again insert the key into the engine key switch apparatus in order to start preheating the glow plug 5 in the same manner as described in the first preferred embodiment.

Figure 4:
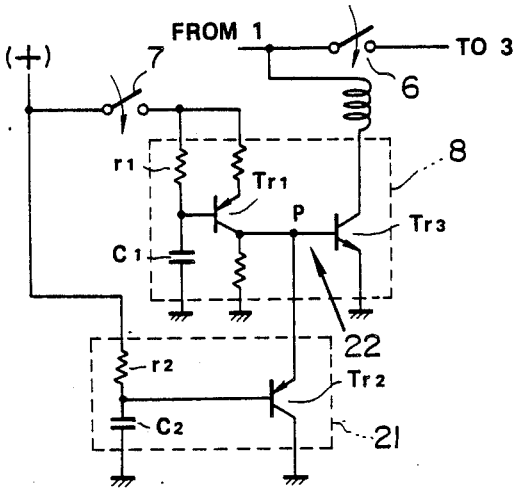
FIG. 4 is a specific internal circuit diagram of a main circuit shown in FIG. 3.

FIG. 4 shows a main circuit in the timers 8 and 21 shown in FIG. 3.

In FIG. 4, symbol (+) denotes a positive side of the battery 1.

When the battery 1 is connected to the circuit shown in FIG. 4 with the key-in switch 7 turned on, a base voltage level of a transistor $Tr_1$ is "L(low)" level for the set period of time t by means of a capacitor-and-resistor circuit $CR_1$ so that a collector voltage level of the transistor $Tr_1$ is "H(high)" level. However, since a base voltage level of a transistor $Tr_2$ is "L" level for the set period of time T so that an emitter of the transistor $Tr_2$ is "L" level (the transistor $Tr_2$ is conducted). Consequently, an electric potential of point P is "L" level for the set period of time T and a transistor $Tr_3$ is in an off state. Therefore, the relay switch 6 remains in an off state so that the glow plug 5 receives no power supply for the set period of time T. After the expiration of the set period of time T, the base of the transistor $Tr_1$ is "H" level so that the transistor $Tr_1$ is in the off state and the base of the transistor $Tr_2$ is "H" level so that the transistor $Tr_2$ is in the off state. Consequently, the potential of point P is "L" level and the transistor $Tr_3$ remains off.

Figure 5:
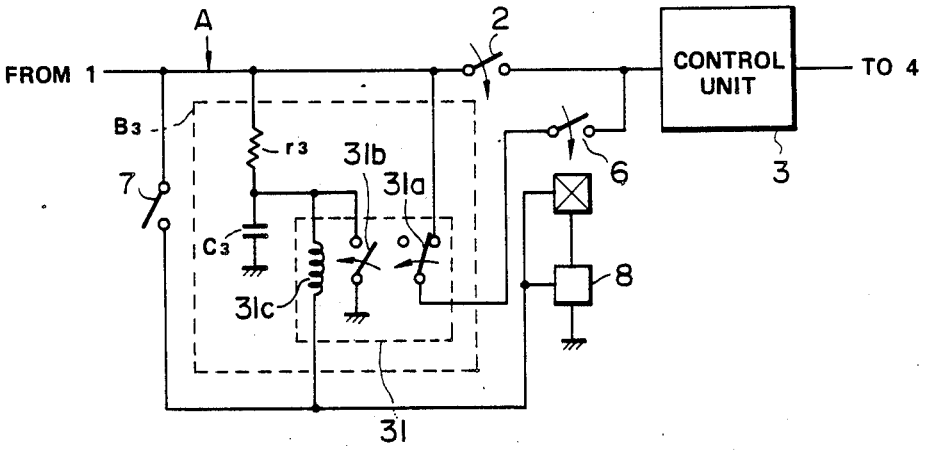
FIG. 5 is a simplified circuit diagram of a third preferred embodiment.

If the engine key is removed from the engine key switch apparatus and again inserted thereinto, the transistor $Tr_1$ is immediately turned on with the transistor $Tr_2$ turned off so that point P has a potential determined by resistance values of both resistors connected to the emitter and collector of the transistor $Tr_1$. Consequently, the transistor $Tr_3$ is turned on and the relay switch 6 is closed so that the glow plug 5 receives the voltage from the battery 1. FIG. 5 shows a third preferred embodiment of the apparatus according to the present invention.

As shown in FIG. 5, the apparatus is provided with another cancel circuit $B_3$ having a capacitor-and-resistor circuit $r_3c_3$ and a self-holding type relay switch 31 in which a pair of normally closed contacts 31*a* (i.e., the circuit line A is normally connected to the control unit 3 via the relay switch 6) is connected in series with one contact of the relay switch 6. In addition, the relay switch 31 has another pair of normally open contacts 31*b* connected across a capacitor $C_3$ of the capacitor-and-resistor circuit $r_3c_3$ and a relay coil 31*c* thereof is connected beteen an intermediate terminal of the capacitor-and-resistor circuit $r_3c_3$ and a connection line from the key-in switch 7 to the timer 8 and to one terminal relay coil of the relay switch 6.

If an operator connects the battery 1 to the circuit line A with the key-in switch 7 turned on, i.e., the engine key inserted into the engine key switch apparatus, the current flows through the key-in switch 7, relay coil 31*c* and capacitor $C_3$. At this time, the timer 8 is simultaneously actuated to turn the relay switch 6 on. However, since the pair of contacts 31*a* is turned off to disconnect the line A from the relay switch 6 with the other pair of contacts 31*b* turned on to ground the coil 31*c*, the control unit 3 receives no current. In the above-described state, the current flows through the relay coil 31*c* and contacts 31*b* to the ground with the coil and contacts being in a self holding state. The self holding state is continued, unless the engine key 7 is removed from the key switch apparatus, i.e., the key-in switch 7 is changed to the off state. If the engine key is once removed from the key switch apparatus, the current flow through the relay coil 31*c* is interrupted and hence the pair of contacts 31*a* is turned on to connect the line A to the relay switch 6. Thereafter, if the engine key is again inserted into the hole of the engine key switch apparatus, the two pairs of contacts 31*a*, 31*b* remain normally closed and normally open, respectively, since no current flows through the coil 31*c* due to the charge potential of the capacitor $C_3$ which is equal to the battery voltage. Therefore, the timer 8 is actuated due to the closure of the key-in switch 7 so that the relay switch 6 is turned on to send the battery current to the control unit 3.

In the third preferred embodiment described above, the key-in glow control is carried out only if the engine key is again inserted into the engine key switch apparatus after the expiration of a predetermined interval of time (this predetermined interval of time corresponds to a time constant of the capacitor-and-resistor circuit $r_3C_3$ which also corresponds to the set period of time T in the first and second preferred embodiments) until which the battery connection operation is ended. The key-in glow control after the battery 1 is connected to the circuit line A is carried out in conventional way since the capacitor $C_3$ charges and the relay switch 31 is not actuated.

As described hereinabove, since the apparatus for controlling the power supply to the glow plug according to the present invention is provided with the above-described cancel circuit $B_1$, $B_2$, $B_3$ for halting the function of the glow plug power supply circuit, the generation of glow current during the connection operation of the battery can be prevented with the engine key inserted. Consequently, both output terminals of the battery cable terminals in each circuit element of the apparatus will not be damaged. Therefore, the electrical connection operation of the battery is carried out with safety.

It will clearly be understood by those skilled in the art that the detailed description is made in terms of the preferred embodiments and various changes and modifications may be made without departing from the scope and spirit of the present invention, which is to be define by the appended claims.

What is claimed is:

1. An apparatus for controlling the flow of a power supply current to a glow plug for an internal combustion engine, comprising:

(a) first means for allowing a power supply current to flow from a power supply to the glow plug to preheat the glow plug when an engine key is inserted into a hole of an engine key switch apparatus; and (b) second means for halting the current flow to the glow plug through said first means for a predetermined period of time when the power supply for the glow plug is first connected to said first means.

2. The apparatus according to claim 1, wherein said second means comprises a timer connected in series with the power supply and a relay switch which is normally closed, the relay switch being open in response to an actuation of the timer for the predetermined period of time so that the glow plug receives no preheat current from the power supply for the predetermined period of time.

3. The apparatus according to claim 2, wherein said first means comprises: (a) a key-in switch installed within said engine key switch apparatus and which is closed when the engine key is inserted into the engine key switch apparatus; (b) a second timer connected in series with said key-in switch; and (c) a relay switch which is closed for another predetermined period of time in response to an actuation of said second timer so that the voltage from the power supply is sent to the glow plug via the relay switch of said second means, the predetermined period of time for which said relay switch of said first means is closed being shorter than that for which said relay switch of said second means is open so that when the engine key switch is removed from said engine key switch apparatus and again inserted thereinto after the predetermined period of time for which the relay switch of said second means is open, the glow plug receives the preheat current from the power supply.

4. The apparatus according to claim 1, wherein said first means comprises: (a) a key-in switch which is installed within said engine key switch apparatus and which is closed when the engine key is inserted into the engine key switch apparatus; (b) a timer which outputs a signal for another predetermined period of time which is shorter than that of said second means when the key-in switch is closed and the voltage from the power supply is received; and (c) a relay switch which is closed in response to the signal from said timer so that the glow plug receives a preheat current from the power supply, and wherein said second means comprises a second timer which is connected in series with the power supply and which outputs a signal so that the timer of said first means does not output the signal to said relay switch for the predetermined period of time after the power supply is first connected to the first means.

5. The apparatus according to claim 1, wherein said first means comprises: (a) a key-in switch which is installed within the engine key switch apparatus and which is closed when the engine key is inserted into the engine key switch apparatus; (b) a timer connected in series with the key-in switch and which outputs a signal for another predetermined period of time in response to the closure of the key-in switch; and (c) a relay switch which is closed in response to the signal from said timer, and wherein said second means comprises: (a) a capacitor-and-resistor circuit connected in series with the power supply; and (b) a self-holding type relay switch having (i) an electromagnetic coil which is connected between the key-in switch and capacitor of the capacitor-and-resistor circuit and which is energized in response to the closure of the key-in switch so that the current from the power supply flows through the key-in switch, electromagnetic coil, and capacitor of said capacitor-and-resistor circuit, (ii) a normally open contact which is closed when the electromagnetic coil is energized and (iii) a normally closed contact which is open to disconnect the power supply from the relay switch of said first means when the electromagnetic coil is energized so that the glow plug receives no preheat current.

6. The apparatus according to claim 5, wherein a time constant of the capacitor-and-resistor circuit corresponds to the predetermined period of time for which said second means halts the current flow through the first means into the glow plug.

* * * * *